United States Patent [19]

Boschetto, Jr. et al.

[11] Patent Number: 4,466,315

[45] Date of Patent: Aug. 21, 1984

[54] COMBINATION TOOL INCLUDING SPANNER WRENCH AND SCREWDRIVER

[76] Inventors: Benjamen J. Boschetto, Jr., 17685 Racoon Ct., Morgan Hill, Calif. 95037; Timothy T. White, 1733 DeMarietta, #3, San Jose, Calif. 95126

[21] Appl. No.: 411,640

[22] Filed: Aug. 26, 1982

[51] Int. Cl.[3] ..... B25B 15/00; B25B 13/00

[52] U.S. Cl. ..... 81/437; 81/90 R; 81/43 B

[58] Field of Search ..... 81/437, 438, 90 B, 90 C, 81/90 E, 90 D, 90 R

[56] References Cited

U.S. PATENT DOCUMENTS 2,667,194 1/1954 Fischer et al. ..... 81/438

FOREIGN PATENT DOCUMENTS 473744 5/1951 Canada ..... 81/90 R
1112073 11/1955 France ..... 81/438
540859 11/1941 United Kingdom ..... 81/90 R

*Primary Examiner*—Frederick R. Schmidt
*Assistant Examiner*—J. T. Zatarga
*Attorney, Agent, or Firm*—John J. Leavitt

[57] ABSTRACT

A combination tool that is utilized to drive simultaneously a screw requiring a screwdriver as a driving element and a screw requiring a spanner wrench as a driving element. The combination tool is fabricated in separate parts which utilize detents to snap the parts together to releasably retain them in operative position.

7 Claims, 6 Drawing Figures

COMBINATION TOOL INCLUDING SPANNER WRENCH AND SCREWDRIVER

BACKGROUND OF THE INVENTION

1. Field of the Invention

This invention relates to tools, and particularly to combination tools which utilize a screwdriver type driving tool in combination with a spanner wrench type of tool.

2. Description of the Prior Art

The tool forming the subject matter of this invention was designed especially to meet the needs of the type of adjustable connector assembly disclosed and claimed in U.S. patent application Ser. No. 379,128 filed in the name of one of the joint inventors of this application. It constitutes an improvement over the combination spanner wrench and screwdriver tool disclosed in that presently pending application.

To our knowledge, there does not exist a combination tool that constitutes both a screwdriver and a spanner wrench which may be utilized to drive the type of adjustable connector assembly disclosed in the above noted U.S. patent application.

One of the objects of the present invention is to provide a tool that constitutes both a spanner wrench and a screwdriver which may be manufactured in different sizes to fit different sizes of adjustable connector assemblies, and which may be snapped onto a conventional driver through the use of spring-pressed detents.

Still another object of the invention is the provision of a combination spanner wrench and screwdriver assembly in which the relationship of the spanner wrench portion of the tool may be adjusted axially with respect to the screwdriver head.

Still another object of the invention is the provision of a tool head encompassing a spanner wrench which may be utilized without the screwdriver portion, and which is detachably securable to a conventional spring-pressed detent-equipped drive handle.

A still further object of the invention is the provision of a tool head encompassing a spanner wrench, equipped with socket means for receiving a detachably securable screwdriver head therewithin, the screwdriver head being retained within the tool socket by resilient detent means.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the combination tool of the invention encompasses and includes a tool head provided with spanner lugs on one end and provided with a socket at the opposite end for releasable attachment to a drive handle. Associated with the end of the tool head having the spanner lugs, is a second socket adapted to receive and releasably retain through the use of resilient detents, a screwdriver head, preferably of the Phillips-head screwdriver type. Obviously, a blade type screwdriver may also be used instead of a Phillips-head screwdriver. In one embodiment of the invention, the tool head from which project the spanner lugs is provided with adjustable stop means for controlling the depth to which the screwdriver head may be inserted into the socket provided for it in the tool head.

DESCRIPTION OF THE PREFERRED EMBODIMENT

Figure 1:
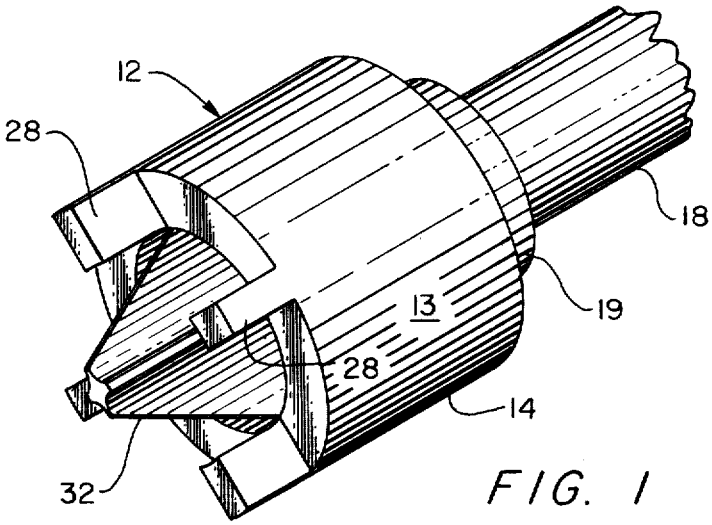
FIG. 1 is a perspective view illustrating the combination tool of the invention apart from a drive handle.

In terms of greater detail, the combination tool of the invention encompasses both a spanner wrench and a screwdriver head. Referring to FIG. 2, the combination tool of the invention is shown in use in association with an adjustable connector assembly which forms no part of this invention. It will be seen that the adjustable connector assembly comprises a first connector member designated generally by the numeral 2, and a second connector member designated generally by the numeral 3. The first connector member comprises an elongated generally cylindrical sleeve 4 having threads 6 on its exterior periphery, and having a central bore 7 defined by an inner peripheral surface 8 symmetrical with respect to the longitudinal axis 9 of the sleeve-like structure. As illustrated in FIG. 2, the sleeve like structure is provided adjacent one end with peripheral slots extending longitudinally of the sleeve-like body, the peripheral slots being adapted to be engaged by the spanner wrench portion of the combination tool as will hereinafter be described. The second connector member is rotatably disposed and trapped against longitudinal displacement within the tubular or sleeve-like first member and, constitutes a conventional screw the head of which is interlocked with the surrounding sleeve-like first member with the first and second members being rotatable in relation to each other. Thus, since the second connector member constitutes a conventional screw and is provided with a conventional screwdriver slot or Phillips-head screwdriver recess, it requires that type of tool to rotate the second connector member. Since the two members are locked against axial displacement, it is necessary to simultaneously rotate the outer or surrounding sleeve-like connector member 2. That being the case, there is required a single tool that will drive both relatively rotatable members so that during the driving operation both of the connector members will rotate simultaneously. To achieve this function, we have provided the combination tool illustrated in FIGS. 1 and 3.

Figure 2:
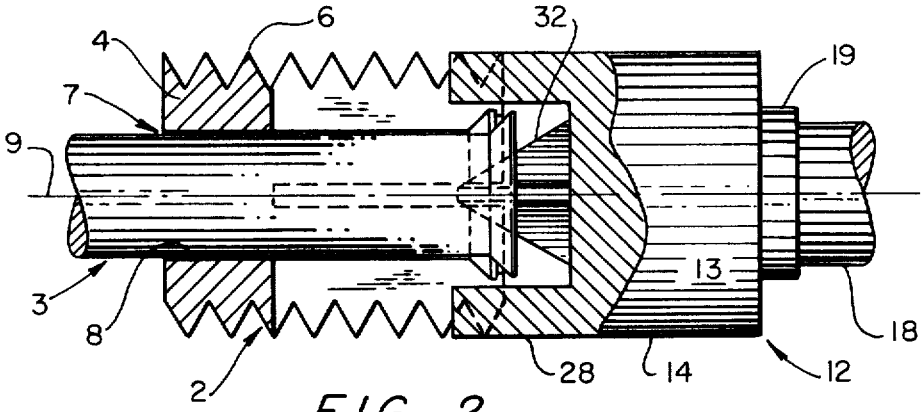
FIG. 2 is a fragmentary cross sectional view illustrating the combination tool in operative association with an adjustable connector assembly incorporating an element adapted to be driven by a screwdriver and an element adapted to be driven by a spanner wrench.
Figure 3:
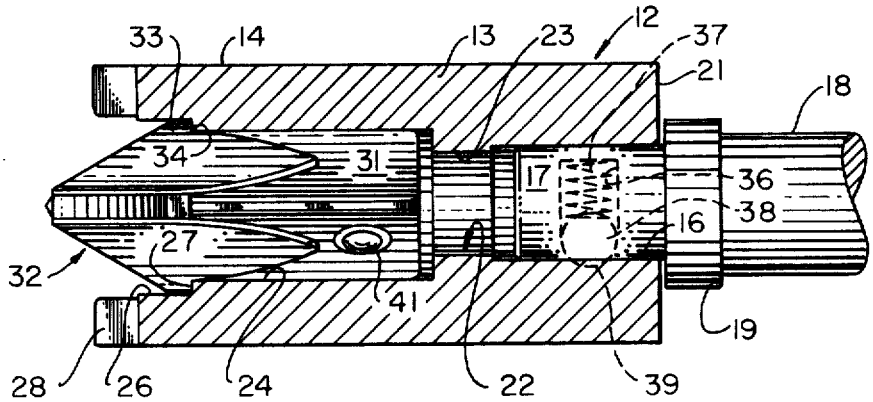
FIG. 3 is a fragmentary cross sectional view partly in elevation illustrating one embodiment of the combination tool head of the invention.

Referring to FIGS. 1 and 3, it will be seen that the combination tool head of the invention is designated generally by the numeral 12, the combination tool including a cylindrical body portion 13 having a smooth outer wall 14 and an inner bore that is divided into a socket portion 16, conveniently hexagonal or square in its configuration and adapted to snugly receive therewithin the drive portion 17 of a drive handle 18, a portion of which has been broken away to shorten the length of the view. The drive handle 18 is provided with an enlarged diameter portion 19 adapted to abut the end 21 of the cylindrical body 13 as illustrated and to thus limit the degree of insertion of the drive portion 17 into the bore 16.

Disposed intermediate the ends of the cylindrical member 13 is a radially inwardly projecting wall portion 22 having a bore 23 smaller in cross sectional dimension than the socket 16, and smaller also in cross sectional dimension than the socket 24 formed in the opposite end of the tool body 13. The socket 24 is provided with an enlarged diameter portion 26 providing a shoulder 27 for purposes which will hereinafter be explained. Additionally, the extreme end portion of the cylindrical body 13 is provided with axially extending lugs 28 circumferentially spaced about the end of the cylindrical body and preferably being four in number at 90° intervals. The lugs 28 constitute spanner lugs adapted to span the diameter of the screw head as illustrated in FIG. 2, and to engage the peripheral slots formed in the first connector body 2 illustrated in FIG. 2. The socket 24 is adapted to snugly receive the shank portion 31 of a screwdriver head 32, the screwdriver head in this instance being illustrated as a Phillips-head screwdriver head. To limit penetration of the screwdriver head 32 into the socket 24, the screwdriver head is provided with an increased diameter portion 33 extending circumferentially about the screwdriver head, and adapted to provide a shoulder 34 dimensioned to snugly abut the shoulder 27 formed in the bore 24.

To retain the drive handle 18 and its driving portion 17 in the socket 16, the drive portion is provided with a transversely extending bore 36 within which is trapped a spring 37 adapted to impinge against a detent ball 38 as illustrated. The detent ball, being resiliently biased radially by the spring 37, is adapted to seat in an appropriate recess 39 formed in the inner peripheral surface 16 of the socket.

In like manner, the screwdriver head 32 is provided with a similar spring-pressed detent, the ball portion 41 being visible in FIG. 3. When the screwdriver head 32 is inserted into the bore 24, the spring-pressed detent ball 41 is adapted to similarly engage an appropriate recess formed in the inner peripheral surface of the socket 24 so as to detachably retain the screwdriver head 32 mounted within the cylindrical body 13.

It will thus be seen that this tool, as depicted in FIG. 3, may be applied to the adjustable connector assembly illustrated in FIG. 2 so that the spanner lugs 28 engage the peripheral slots in the first connector member 2, while the screwdriver head 32 engages the recess in the connector member 3 so as to drive both connector members simultaneously.

Figure 4:
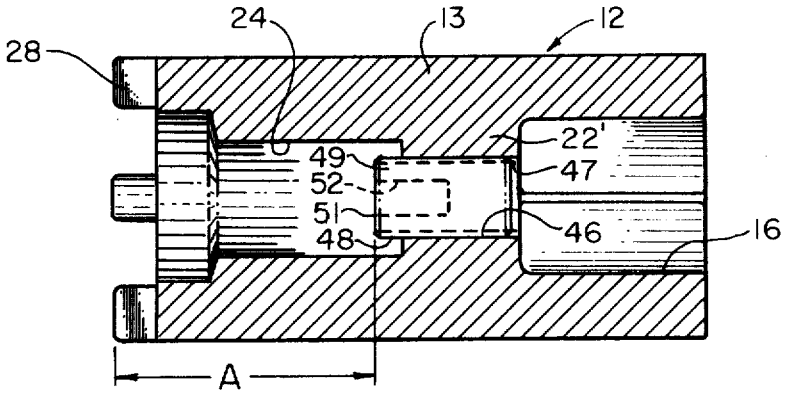
FIG. 4 is a vertical cross sectional view of a spanner wrench head apart from the screwdriver head, and incorporating means for adjusting the depth of the screwdriver head in relation to the spanner wrench portion of the tool.

In the embodiment of the invention illustrated in FIG. 4, the cylindrical body 13 is essentially the same as the body illustrated in FIG. 3, and similar elements have been illustrated and referred to by similar reference numbers. In this embodiment however, there is provided a central body portion 22' that extends radially inwardly to a greater degree than the corresponding element in the FIG. 3 embodiment. Additionally, in FIG. 4, the radially inwardly extending central body portion 22 constitutes a transverse wall that is provided with a bore 46 having internal threads 47 adapted to be engaged by the external threads 48 of a set screw 49.

Since the set screw 49 is coaxially arranged along the longitudinal axis of the cylindrical body member 13, rotation of the set screw causes the end 51 thereof to be positioned closer or further away from the spanner lugs 28 to thus selectively vary the dimension A illustrated in FIG. 4 and by so doing, limiting the depth to which the screwdriver head 32 may be inserted into the socket 24. It is conceivable, for instance, that the setting of the set screw will hold the screwdriver head out sufficiently to prevent engagement of the spanner lugs, thus permitting the use of only the screwdriver in some applications. As with the socket 24 in the embodiment illustrated in FIG. 3, socket 24 of the embodiment illustrated in FIG. 4 is conveniently square in cross sectional configuration so as to firmly retain the screwdriver head 32 against rotation in relation to the surrounding cylindrical body 13. Adjustment of the set screw 49 is accomplished by inserting an Allen-wrench (not shown) into the socket 52 provided in the set screw for that purpose.

Figure 5:
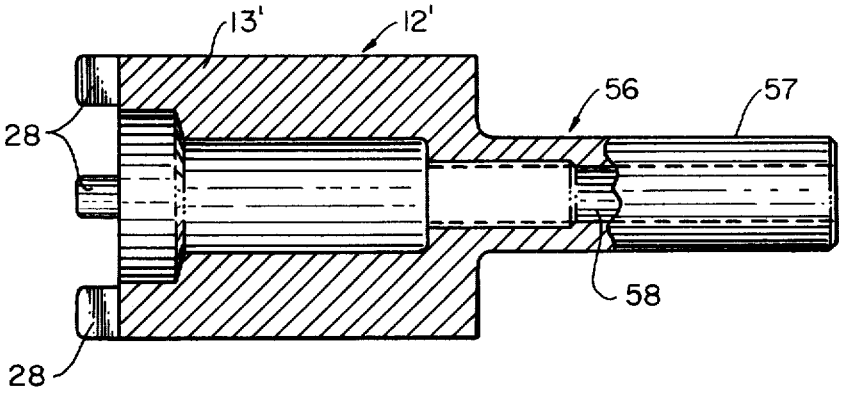
FIG. 5 is a combination tool head adapted for use in connection with a drill motor to drive the tool head, the tool head being adapted to receive a releasably detachable screwdriver head in association with the spanner portion of the tool head.
Figure 6:
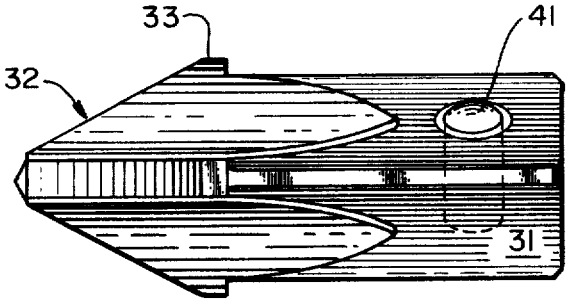
FIG. 6 is an elevational view of a screwdriver head equipped with a spring-pressed detent and adapted to be engaged in the socket portion of the combination tool head illustrated in FIGS. 3 through 5.

The embodiment illustrated in FIGS. 3 and 4 are adapted to be used in conjunction with a manual driver or drive handle, socket portion 17 of which is inserted into the socket 16 in the cylindrical body. In the embodiment of the invention illustrated in FIG. 5, the cylindrical body 13' has been modified somewhat in that the socket 16 has been eliminated and instead, there is provided as an integral extension from the cylindrical body 13' a shank portion 56 having an external peripheral surface 57 adapted to be engaged by the adjustable jaws of a drill motor chuck (not shown) so that the tool may be driven by a drill motor.

Additionally, the extension 56 of the cylindrical body 13 is provided with a central bore 58 so that when the screwdriver head 32 is mounted in the square socket 24 and is resiliently retained therein by the detent ball 41, an elongated tool may be inserted through the central bore 58 to push the screwdriver head 32 out of engagement with the surrounding cylindrical body 13. As with the other embodiments, this embodiment is provided with similar spanner lugs 28 adapted to engage the complimentary peripherally positioned slots formed in the first connector member 2 illustrated in FIG. 2.

Having thus described the invention, what is considered to be new and novel and sought to be protected by Letters Patent of the United States is as follows:

I claim:

1. A combination tool comprising detachable spanner wrench and screwdriver portions, (a) said spanner wrench portion including a cylindrical body having a pair of sockets formed in opposite ends and a plurality of spanner lugs projecting from one end of the body adjacent one of said sockets;

(b) said screwdriver portion including a screwdriver head detachably engaged in said socket associated with said spanner lugs and (c) means provided in said spanner wrench portion adjustable to control the depth of engagement of said screwdriver head in said spanner wrench portion.

2. The combination according to claim 1, in which spring-pressed detent means are provided interposed between said spanner wrench portion and said screwdriver head portion to resiliently retain the two members detachably interlocked.

3. The combination according to claim 1, in which said spanner wrench lugs project axially from the end of said cylindrical spanner wrench body portion and are spaced circumferentially 90° apart.

4. The combination according to claim 1, in which said sockets are non-cylindrical.

5. In a spanner wrench, a generally enlongated cylindrical body, a socket formed in at least one end of said body and having a non-circular cross section, and circumferentially spaced spanner lugs integral with the opposite end of said cylindrical body and projecting axially therefrom;

(a) socket means of non-circular configuration provided in both ends of said cylindrical body; and (b) transverse wall means provided in said body disposed between said two sockets, and adjustable stop means are provided mounted on said wall and adjustable to project more or less into one of said sockets.

6. The combination according to claim 5, in which socket means are provided in each end of said cylindrical body, and a screwdriver head is detachably engaged in said socket associated with said spanner lugs.

7. The combination according to claim 5, in which said cylindrical body is provided with a reduced diameter extension adapted to be grasped by the adjustable jaws of a drill motor chuck to effect rotation of said cylindrical body.

* * * * *